US006719157B2

(12) United States Patent
Stoddart et al.

(10) Patent No.: US 6,719,157 B2
(45) Date of Patent: Apr. 13, 2004

(54) ORGANIZER

(75) Inventors: Darren W. Stoddart, Joplin, MO (US); James A. Sellors, Chesterfield, MO (US)

(73) Assignee: Rubbermaid Closet & Organization Products Company, Freeport, IL (US)

( * ) Notice: Subject to any disclaimer, the term of this patent is extended or adjusted under 35 U.S.C. 154(b) by 29 days.

(21) Appl. No.: 10/016,690

(22) Filed: Dec. 13, 2001

(65) Prior Publication Data

US 2003/0111434 A1 Jun. 19, 2003

(51) Int. Cl.[7] ..... A47F 5/00

(52) U.S. Cl. ..... 211/118; 211/34; 211/38; 248/99

(58) Field of Search ..... 211/34.38, 113, 211/118, 85.29, 85.15, 85.24; 248/99

(56) References Cited

U.S. PATENT DOCUMENTS

| | | | | |
|---|---|---|---|---|
| 2,845,185 A | | 7/1958 | Winderweedle, Jr. | 211/114 |
| 3,331,513 A | | 7/1967 | Cappelli | |
| 3,669,276 A | | 6/1972 | Woods | |
| 3,934,631 A | * | 1/1976 | Wilson et al. | 248/99 X |
| 4,282,911 A | * | 8/1981 | Sumitomo | |
| 4,580,667 A | | 4/1986 | Herwood | |
| 4,585,127 A | | 4/1986 | Benedict | |
| 4,588,154 A | * | 5/1986 | Basore | 248/99 |
| 4,694,503 A | * | 9/1987 | Hydorn | 248/99 |
| 4,773,585 A | * | 9/1988 | Lehrman | 248/99 X |
| 4,979,705 A | | 12/1990 | Bovitz | 248/97 |
| 5,107,996 A | | 4/1992 | Whittaker | |
| 5,533,534 A | | 7/1996 | Cariello et al. | |
| 5,540,501 A | | 7/1996 | Franco | 383/13 |
| 5,542,530 A | | 8/1996 | Freelander | 206/292 |
| 5,628,398 A | | 5/1997 | Jackson | |
| 5,683,002 A | | 11/1997 | Rayside | |
| 5,713,646 A | | 2/1998 | Wang | 312/3 |
| 6,126,021 A | * | 10/2000 | Wilhite | 211/113 X |
| 6,318,822 B1 | | 11/2001 | Wang | 312/111 |

FOREIGN PATENT DOCUMENTS

| | | |
|---|---|---|
| DE | 93 10 013 U | 9/1993 |
| DE | 299 17 890 U | 2/2000 |

OTHER PUBLICATIONS

Organize—Everything.com, 5 pages, copyright 1998–2002, Organize Everything, Inc.*

Closetmaid—Product Catalog, www.closetmaid.com, 6 pages, printed Jan. 29, 2002.

International Search Report for PCT/US02/40055 dated Apr. 14, 2003.

* cited by examiner

*Primary Examiner*—Robert W. Gibson, Jr.
(74) *Attorney, Agent, or Firm*—Marshall, Gerstein & Borun LLP

(57) ABSTRACT

An organizer for use with a closet rod extending along an axis includes a row of side-by-side compartments at least partially formed from a flexible material. Each side-by-side compartment has a floor, a pair of side walls extending from the floor and a mouth between the side walls. The organizer further includes a suspender coupled to the row of side-by-side compartments. The suspender is configured and adapted to hang the plurality of compartments from the closet rod such that each mouth faces a forward horizontal direction perpendicular to the axis of the closet rod when the organizer is hung from the rod.

34 Claims, 12 Drawing Sheets

50
50
50
18
12
20
22
16
24
26
28
14
10
5
5
6
6
7
7
66
38
40

12
50
310
50
18
50
36
16
34
32
34
36
39
32
32
16
14
36
333
317
339
319
323
317
313
315
317
313
317
325
327
327

ORGANIZER

FIELD OF THE INVENTION

The present invention relates to methods and devices for organizing and storing various objects. In particular, the present invention relates to an organizer having a plurality of compartments and adapted to be hung in a room or closet.

BACKGROUND OF THE INVENTION

Over time, storage areas such as closets and the like become disorganized and cluttered as items accumulate. For example, bedroom closets frequently become cluttered with shoes and various articles of clothing. As a result, items located within such storage areas are difficult to find when needed and frequently become damaged or broken upon contacting other items or upon being stepped on. Matched or paired items such as shoes frequently become separated.

In an attempt to solve this organization dilemma, various storage organizers including racks, shelves and drawers and pockets have been marketed. Although providing some organization to the storage area clutter, such organizers have numerous drawbacks. In particular, although racks and shelves elevate the stored items, the stored items frequently become cluttered and disheveled on the shelves or racks themselves. Moreover, because such racks, drawers and shelves are formed from rigid materials, such as wire, wood and metal, such organizers are cumbersome and difficult to set up, requiring additional mounting hardware.

Although organizers including drawers or vertical pockets individually store items, drawers and vertical pockets partially, if not completely, conceal the items being stored. To view and identify the stored items, a user must either open the drawer, peer down into the vertical pocket or initially position the item in the vertical pocket such that a portion of the item projects from the vertical pocket where it is exposed and susceptible to becoming dislodged or damaged.

One prior attempt to solve such problems associated with racks, shelves, drawers and vertical pockets has been the development of a shoe display bag and system such as described in U.S. Pat. No. 3,669,276. In particular, the shoe display bag and system provides a single column of shoe compartments formed from a flexible material such as lightweight canvas. Each compartment is sized to receive a single shoe.

While representing an improvement over the use of shelves, racks, drawers or vertical pockets for displaying and organizing shoes, numerous drawbacks associated with this system have been left unattended. In particular, because the mouths of the compartments face in a direction parallel to the rod supporting the system, the system is not well suited for use in closets. Although the system is described as including a hanger for enabling household use, the hanger increases hanging instability, while increasing the complexity and cost of the system. Moreover, the shoe display bag and system results in an inefficient use of storage space.

Thus, there is a continuing need for an organizer that is lightweight, that compartmentalizes stored items, that facilitates viewing of stored items, that is relatively stable and that efficiently uses available storage space.

SUMMARY OF THE INVENTION

According to one exemplary embodiment of the present invention, an organizer for use with a closet rod extending along an axis includes a row of side-by-side compartments at least partially formed from a flexible material. Each side-by-side compartment has a floor, a pair of side walls extending from the floor and a mouth between the side walls. The organizer further includes a suspender coupled to the row of side-by-side compartments. The suspender is configured and adapted to hang the plurality of compartments from the closet rod such that each mouth faces a forward horizontal direction perpendicular to the axis of the closet rod when the organizer is hung from the rod.

According to yet another exemplary embodiment, an organizer for use with a closet rod extending along an axis includes a plurality of compartments coupled to one another and a suspender coupled to the plurality of compartments. The plurality of compartments are vertically and horizontally arranged with each compartment having a floor, a pair of side walls extending from the floor and a mouth between the side walls. The suspender is configured and adapted to hang the plurality of compartments from the closet rod such that the mouth of each compartment faces in a forward horizontal direction perpendicular to the axis of the closet rod when the organizer is hung from the rod.

According to yet another exemplary embodiment, an organizer includes a plurality of side-by-side compartments at least partially formed from a flexible material and a suspension device coupled to the plurality of side-by-side compartments. The compartments are at least partially formed from a flexible material with each compartment having a floor, a pair of side walls extending from the floor and a mouth between the side walls. The suspension device is configured to suspend the plurality of side-by-side compartments such that the mouth of at least one side-by-side compartment faces in a horizontal direction when the compartments are suspended.

DETAILED DESCRIPTION OF THE PREFERRED EMBODIMENTS

Figure 1:
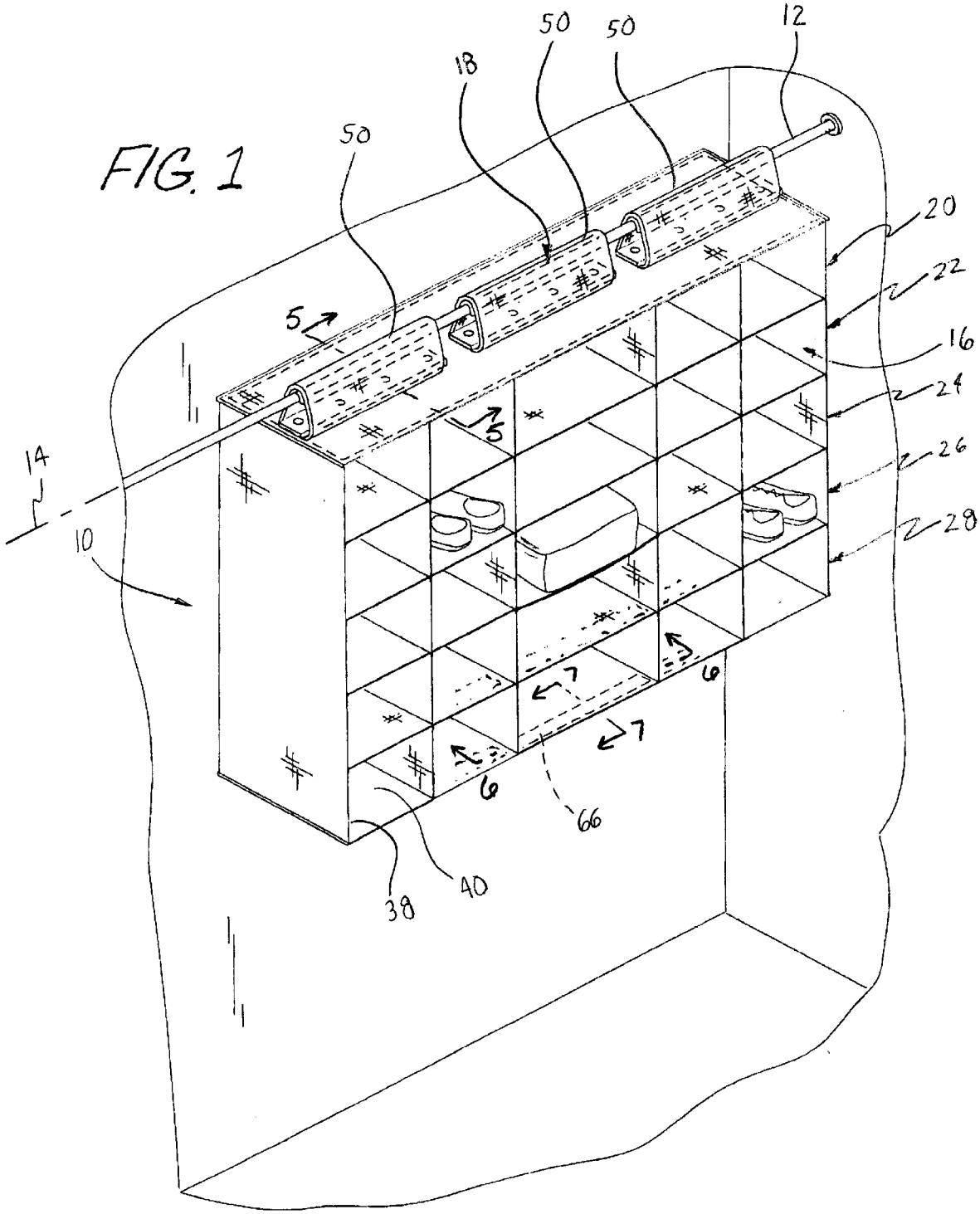
FIG. 1 is a perspective view illustrating an exemplary embodiment of an organizer of the present invention hung from a closet rod.

FIG. 1 is a perspective view of organizer 10 hung or suspended from a closet rod 12 extending along an axis 14. Although the closet rod is illustrated as a cylindrical member having a depicted outer diameter, organizer 10 may be adapted to be hung from a closet rod having any of a variety of exterior cylindrical and non-cylindrical configurations as well as having a variety of differing diameters. Organizer 10 generally includes compartments 16 and suspension device 18. Compartments 16 extend side-by-side one another in a plurality of substantially horizontal rows 20, 22, 24, 26 and 28.

Figure 2:
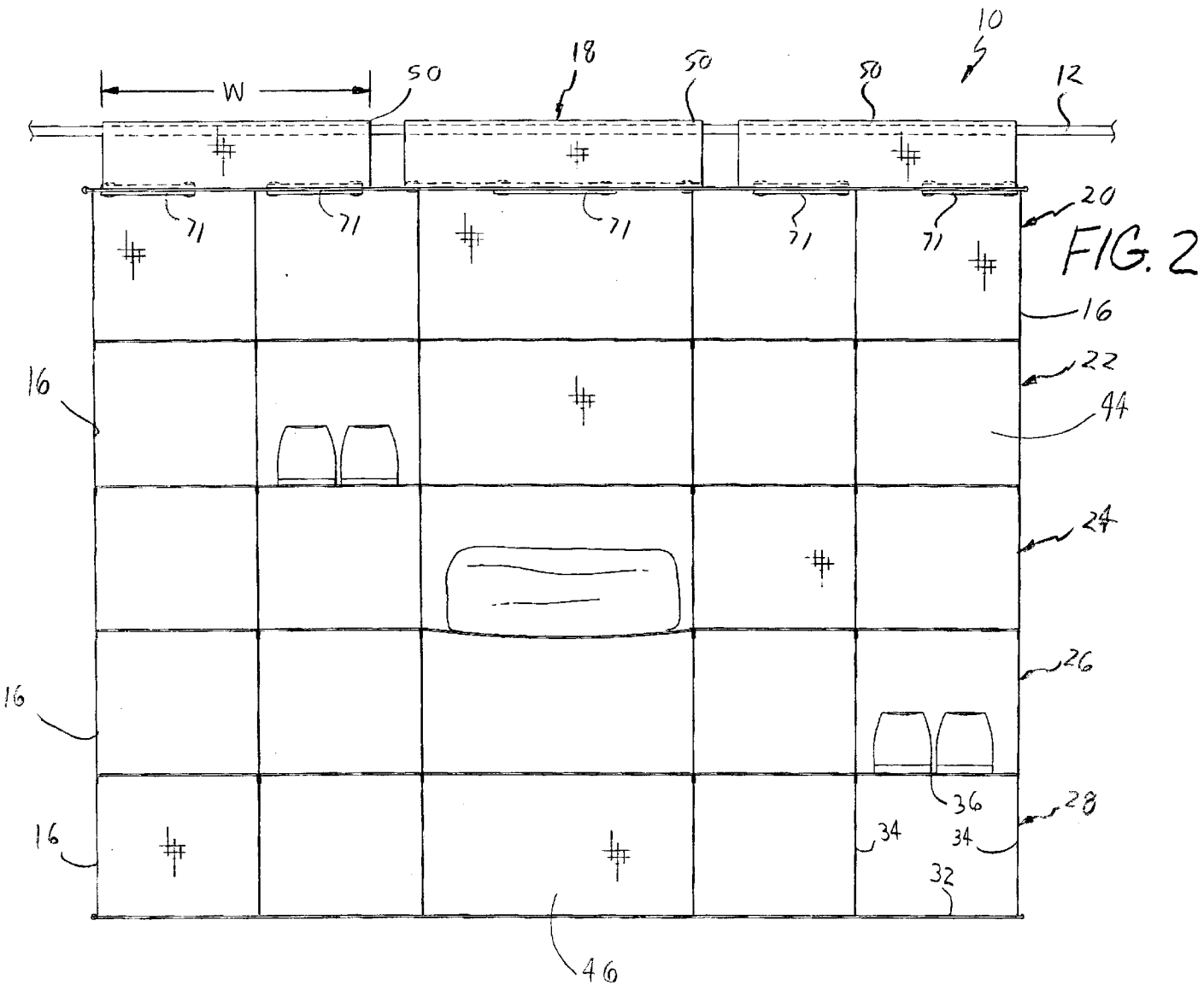
FIG. 2 is a front elevational view of the organizer of FIG. 1.

As best shown by FIG. 2, each compartment includes a floor 32, a pair of side walls 34 extending from the floor and a roof 36. Floor 32, side walls 34 and roof 36 form a mouth 38 located above the floor 32 and between the side walls 34. Mouth 38 is sufficiently sized so as to enable the interior 40 of each compartment 16 to be viewed. In the preferred embodiment, each compartment 16 has an interior 40 having a volume provided by a constant cross sectional area equal to the cross sectional area of mouth 38. As a result, the entire interior 40 of each compartment 16 may be easily inspected.

As best shown by FIG. 2, compartments 16 and rows 20–28 are preferably arranged in a grid. In particular, side walls 34 extend parallel to one another while floor 32 and roof 36 also extend parallel to one another. Side walls 34 preferably extend perpendicular to floor 32 and roof 36 such that each compartment 16 has a generally rectangular cross section. Although less desirable, compartment 16 may alternatively have other cross sectional shapes.

As further shown by FIG. 2, compartments 16 are preferably arranged and dimensioned in a symmetrical fashion. In particular, compartments 16 of each of rows 20–28 has an equal vertical height. As a result, easier location of a correctly dimensioned compartment 16 for receiving shoes or other objects is facilitated. In alternative embodiments, one or more of compartments 16 in one or more of rows 20–28 may have a greater height to accommodate objects having a greater height. In the preferred embodiment, at least two compartments of at least one row of rows 20–28 are vertically aligned with compartment 16 of underlying or overlying rows 20–28 such that the side walls 34 of the compartments of the vertically offset rows extend in a common vertical plane. For example, the compartment 16 of organizer 10 preferably includes two distinct sizes of compartments: smaller compartments 44 and larger compartments 46. The smaller compartments 44 have the same horizontal width as both the underlying and overlying smaller compartments 44. The larger compartments 46 have the same horizontal width as underlying and overlying larger compartments 46. This arrangement provides organizer 10 with an aesthetically attractive symmetrical appearance. Moreover, this arrangement of compartments 16 enables quick identification of the appropriate sized compartment 16 for differently sized objects. Furthermore, because the side walls of adjacent compartments extend in a common vertical plane, single panels of one or more layers may be used to provide the side walls for compartment 16 of multiple rows 20–28, simplifying manufacture. Although less desirable, compartments 16 of adjacent rows 20–28 may be arranged so as to not be vertically aligned with one another such that a side wall of one compartment 16 may extend in a different vertical plane than the side wall of an underlying or overlying compartment 16.

In the exemplary embodiment, smaller compartments 44 are preferably dimensioned so as to be adapted to receive a standard or average pair of shoes, wherein each shoe rests upon floor 36 of compartment 44 in a side-by-side relationship with the other shoe. Compartment 44 preferably has a width of at least about 4.5 inches, a height of at least about 5.0 inches and a depth of at least about 12.0 inches. Nominally, compartment 44 has a width of about 6.0 inches, a height of about 4.5 inches and a depth of about 12.0 inches. Larger compartment 46 is preferably dimensioned so as to be adapted to receive clothing or apparel. Preferably, compartment 46 is dimensioned so as to receive a standard or average folded large adult male sweater. Compartment 46 preferably has a width of at least about 10.0 inches, a height of at least about 5.0 inches and a depth of at least about 12.0 inches. Nominally, compartment 46 has a width of about 10.0 inches, a height of about 5.0 inches and a depth of about 12.0 inches. (A tolerance of ±1 inch is acceptable for the above measurements.)

Figure 2A:
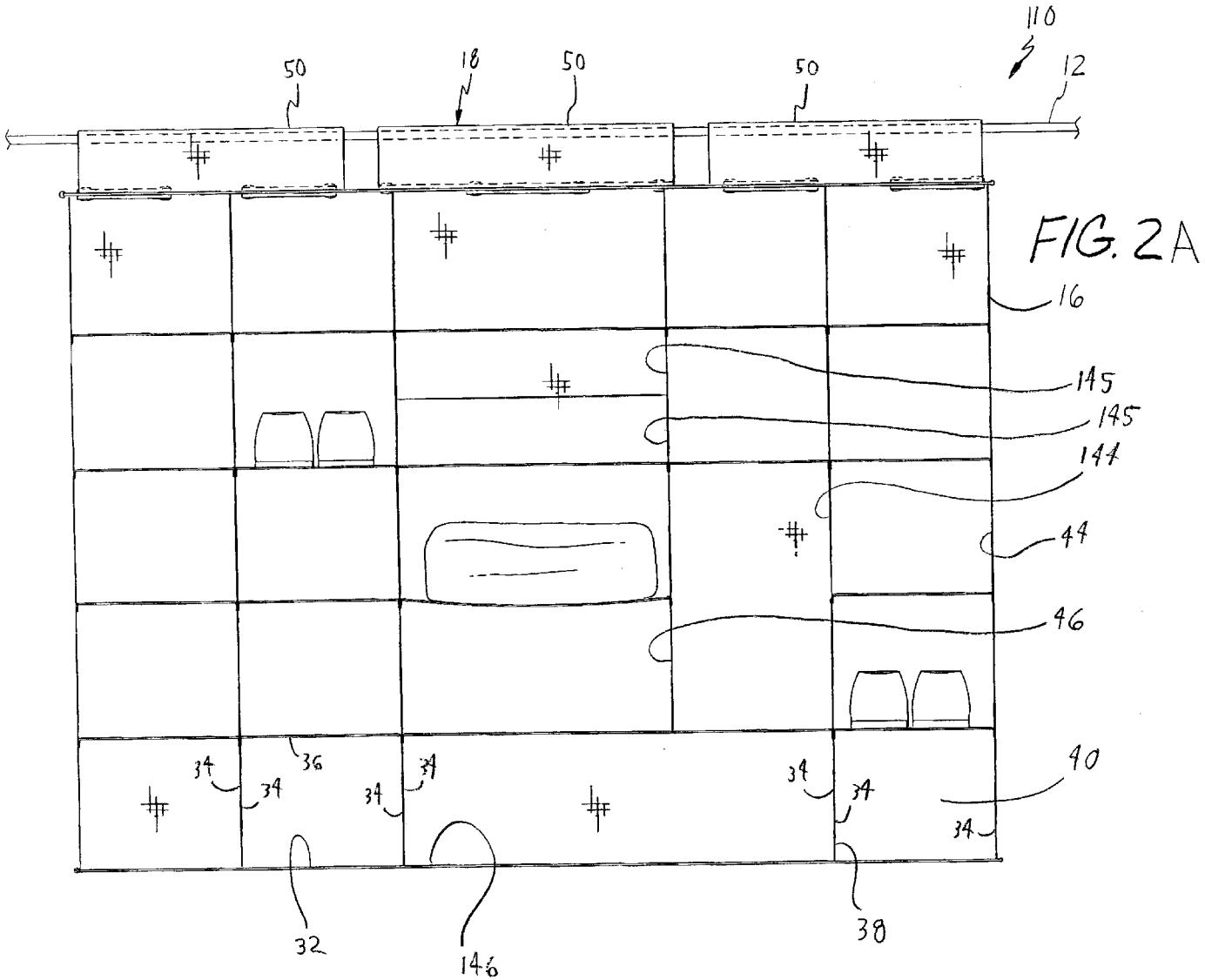
FIG. 2A is a front elevational view of an alternative embodiment of the organizer of FIG. 1.

FIG. 2A is a front elevational view of organizer 110, an alternative embodiment of organizer 10 shown in FIGS. 1 and 2. Organizer 110 is substantially identical to organizer 10 except that organizer 110 is a different arrangement of compartments 16. In particular, organizer 110 includes a tall compartment 144, a short compartment 145 and a wide compartment 146 in addition to compartments 44 and 46. Although having increased manufacturing complexity, organizer 110 provides greater versatility for storing differently sized objects.

Figure 4:
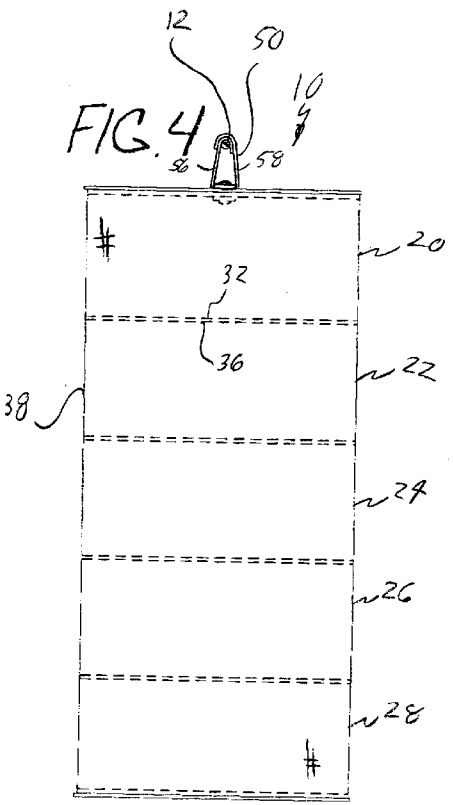
FIG. 4 is a side elevational view of the organizer of FIG. 1.
Figure 3:
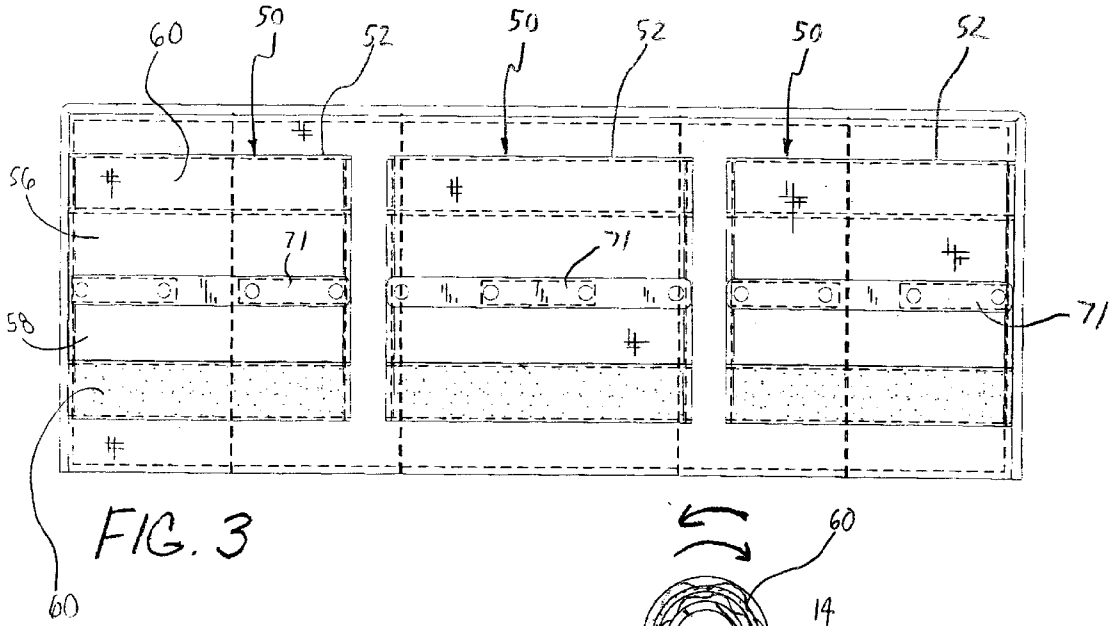
FIG. 3 is a top plan view of the organizer of FIG. 1 separated from the closet rod.
Figure 5:
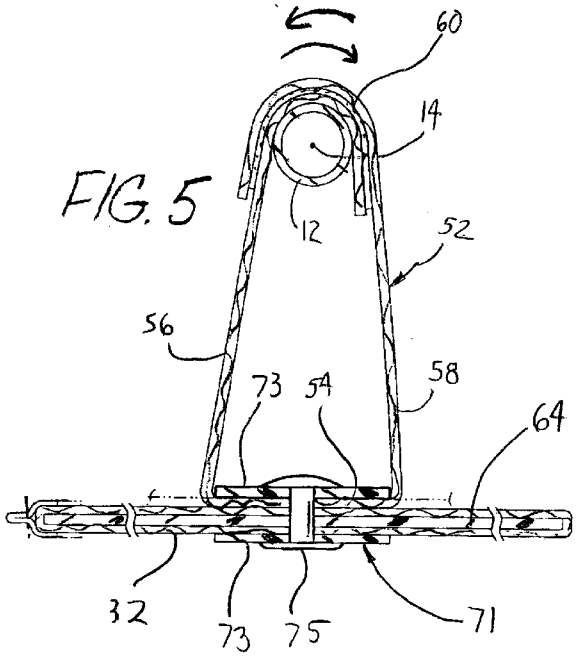
FIG. 5 is an enlarged fragmentary sectional view of the organizer of FIG. 1 taken along line 5—5.

FIGS. 3–5 illustrate suspension device 18 of organizer 10 in greater detail. Suspension device 18 generally comprises a structure coupled to compartments 16 and configured to suspend compartments 16 such that the mouth 38 of each compartment 16 faces in a horizontal direction when the compartments are suspended. In the exemplary embodiment, suspension device 18 comprises a plurality of suspenders 50 coupled to compartments 16. Each of suspenders 50 is configured to hang compartments 16 from a closet rod (such as closet rod 12) such that each mouth 38 faces in a forward horizontal direction perpendicular to axis 14 of rod 12 when organizer 10 is hung from rod 12. In the particular embodiment illustrated, each suspender 50 generally comprises a flap 52 of flexible material, such as canvas, having a middle portion 54, a first end portion 56 and a second end portion 58. Middle portion 54 is coupled to compartments 16 while end portions 56 and 58 extend from middle portion 54. End portion 56 is configured to wrap at least partially about rod 12 while end portion 58 is configured to be releasably coupled to portion 56 so as to form a flexible sleeve receiving closet rod 12. The sleeve formed by flap 52 extends parallel to axis 14 of rod 12 and perpendicular to the forward horizontal direction in which mouths 38 face. Because end portions 56 and 58 are configured to be releasably coupled to one another so as to form a sleeve for receiving closet rod 12, organizer 10 may be suspended from closet rod 12 while closet rod 12 remains fixed in the closet, alleviating the need to remove closet rod 12 to insert closet rod 12 into the sleeve.

In the preferred embodiment illustrated, end portions 56 and 58 are releasably coupled to one another by a hook and loop fastener mechanism 60 known as VELCRO. Preferably, portions of ends 56 and 58 containing the VELCRO component 60 overlap one another on top of or above closet rod 12 at the apex of the sleeve formed by flap 52. As a result, the weight capacity of organizer 10 is increased. Alternatively, portions 56 and 58 may be releasably coupled to one another at alternative points below the top of closet rod 12 and may be releasably coupled to one another by various other fastening mechanisms such as buttons, zippers, buckles, hooks and the like. Although end portions 56 and 58 are illustrated as having substantially equal dimensions, portions 56 and 58 may be alternatively dimensioned such that portion 56 substantially wraps all the way about rod 12 and back into close proximity with middle portion 54 prior to being joined to portion 58. Although flap 52 is illustrated as being formed from a single layer of integral material, flap 52 may be formed from a plurality of layers of the same or different materials coupled to one another or may be formed from a plurality of panels of materials coupled to one another in an end-to-end or side-to-side fashion. Flap 52 may additionally include layers of rigidifying or strengthening material embedded or coupled to flap 52. For example, end portion 56 or 58 may alternatively include a rigid hook encapsulated or covered by the flexible material of flap 56 so as to further strengthen the resulting sleeve formed by portions 56 and 58.

As best shown by FIG. 2, each suspender 50 has a substantial width W extending in a direction parallel to the axis 14 of closet rod 12. As a result, suspenders 50 engage a substantial axial extent of closet rod 12 so as to disperse the load of organizer 10 across closet rod 12 and so as to also disperse the load of organizer 10 across compartments 16. As a result, suspenders 50 reliably and stably suspend organizer 10 from rod 12. Moreover, because there is no single point through which all the load of organizer 10 and its contents must be transmitted to suspenders 50, the load capacity of organizer 10 is increased without the threat of accidental separation of suspenders 50 from the remainder of organizer 10. In the preferred embodiment, each suspender 50 has a width W greater than the thickness of the flap 52. Preferably, width W is greater than the maximum horizontal width of the sleeve provided by suspender 50. As shown by FIG. 2, each suspender 50 has a width W greater than the width of compartment 44 and greater than the width of compartment 46. In the particular embodiment illustrated, each suspender 50 has a width of about 10.0 inches. Although suspension device 18 is illustrated as including three suspenders 50, suspension device 18 may alternatively include a greater number of suspenders 50 or a fewer number of suspenders 50. For example, the three suspenders 50 may alternatively be replaced by a single elongate suspender 50 continuously engaging closet rod 12 by the same axial length as the three illustrated suspenders 50.

As best shown by FIG. 5, each suspender 50 is secured to compartment 16 by a fastening device 71. As best shown by FIGS. 3 and 5, fastening device 71 generally comprises a pair of elongate rigid bands or strips 73 sandwiching roof 32 of compartment 16 of row 30 and rigidifying panel 64 therebetween. Strips 73 additionally capture flap 52 against member 64 to couple suspender 50 to compartment 16. Strips 73 are fixed to one another by means of a fastener 75, such as a metal rivet. Alternatively, suspender 50 may be secured to compartment 16 by various other fastening methods and mechanisms.

FIGS. 3–5 illustrate but one preferred embodiment of suspenders 50. For example, although less desirable, suspenders 50 may alternatively comprise a continuous sleeve which does not have separable portions to enable the sleeve to be opened and to enable organizer 10 to be mounted or dismounted from an existing stationary or fixed closet rod. Although less desirable, suspender 50 may alternatively comprise a hook or other mechanism configured to releasably couple compartments 16 to closet rod 12 such that the mouths 38 of compartments 16 face in a forward horizontal direction perpendicular to the axis of the closet rod. Furthermore, depending upon the particular application, organizer 10 may alternatively be provided with a suspension device 18 not including suspenders 50 and configured to mount or suspend the remainder of organizer 10 from structures other than a closet rod.

Figure 6:
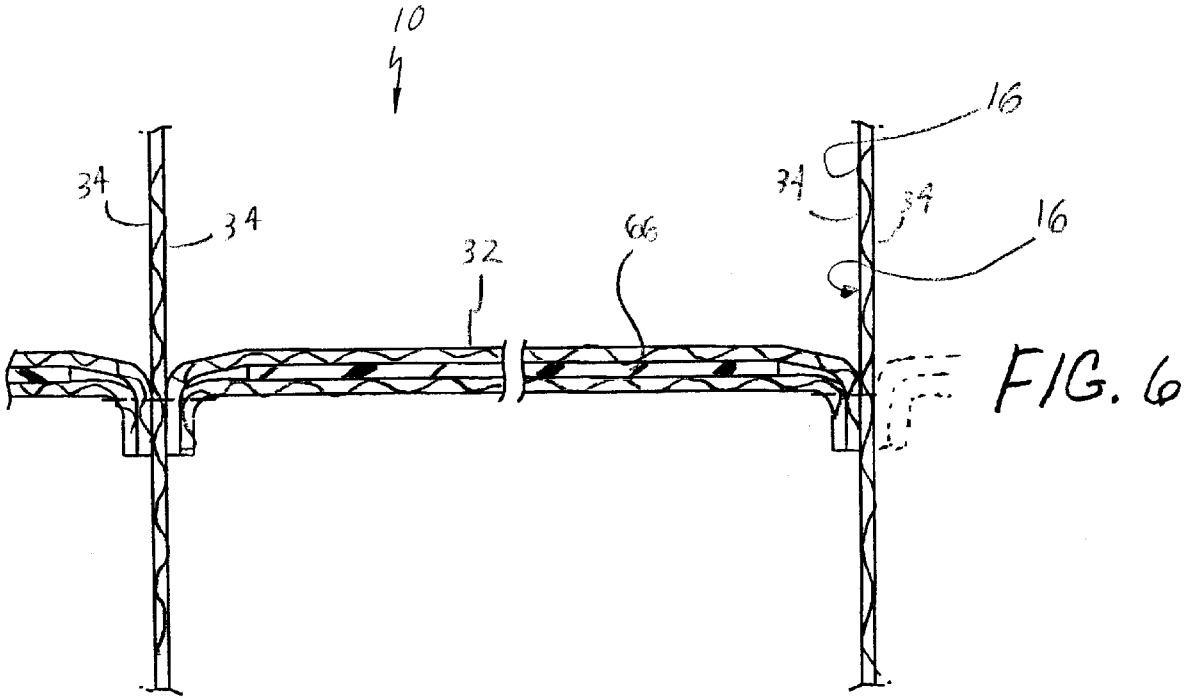
FIG. 6 is an enlarged fragmentary sectional view of the organizer of FIG. 1 taken along line 6—6.
Figure 7:
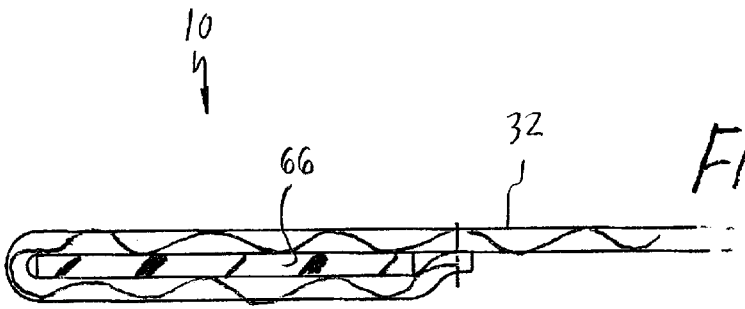
FIG. 7 is an enlarged fragmentary sectional view of the organizer of FIG. 1 taken along line 7—7.

FIGS. 6 and 7 illustrate compartments 16 in greater detail. As best shown by FIG. 6, each side wall 34 of each compartment 16 is provided by a single panel that simultaneously forms the side wall for an adjacent compartment 16. In the exemplary embodiment, the panel simultaneously providing the side walls 34 for two adjacent compartments 16 is a single layer of material. As a result, the partitions between adjacent side-by-side compartments 16 require little volume, enabling organizer 10 to have greater storage capacity while occupying less closet space. In the particular embodiment illustrated, side walls 36 are formed by a panel consisting of a single layer of flexible material such as canvas. Alternatively, side walls 34 may be provided by a panel consisting of multiple layers of flexible material such as canvas, polymers or other natural or synthetic fabrics or materials. Because side walls 34 are preferably formed from a flexible material, organizer 10 is collapsible such that the upper compartments may be compressed towards the lower compartments with side walls 34 folding or bending. As a result, organizer 10 can be compactly shipped or stored. Moreover, organizer 10 is light weight and does not impose substantial load upon closet rod 12.

In a similar fashion, the roof 36 of each compartment 16 (except for those compartments 16 in the uppermost row 20 of compartments 16) is provided by a panel that simultaneously provides the floor 32 of a higher compartment 16. Except for the additional inclusion of a rigidifying structure described hereafter, the panel simultaneously providing the floor 32 and the roof 36 is formed from a single integral material. But for the portion of the material extending about the rigidifying structure, the panel is in the form of a single layer of material. As a result, the storage capacity of organizer 10 is further enhanced while not increasing the volume of closet space required by organizer 10. Similar to side walls 34, floor 32 and roof 36 are also preferably formed from a flexible material such as canvas. Because floor 32 and roof 36, as well as side walls 34, are preferably formed from a fabric material such as canvas, the interior surfaces of compartments 16 are soft and flexible, preventing the shoes or other objects contained therein from becoming scuffed, marked or otherwise damaged after repeated insertion and removal. Because at least one of side walls 34, floor 32 and roof 36 is formed from a flexible breathable or air permeable material, air circulation through organizer 10 is facilitated. Such air circulation may be important to allow adequate ventilation for allowing the escape of moisture from the objects such as shoes and preventing the build-up of odor. Alternatively, other flexible materials such as polymers or other natural or synthetic fiber or materials may be employed. Although less desirable, floor 32, roof 36 and side walls 34 of compartments 16 may be provided by one or more panels of multiple layers of materials coupled to one another by stitching, lamination, adhesives and the like.

As mentioned above, compartments 16 additionally include strengthening or rigidifying members. In particular, the uppermost row 20 of compartment 16 has a roof 32 rigidified by an elongate panel preferably extending across the entire top of organizer 10 below suspenders 50. Panel 64 (shown in FIG. 1) is preferably formed from a cardboard material. Alternatively, panel 64 may be formed from other rigid materials such as plastic, wood or metal.

In addition, floor 32 of each compartment 16 has an elongate rigidifying band or strip 66 secured or supported adjacent to mouth 38. As best shown by FIG. 6, strip 66 substantially extends along floor 32 between side walls 34. As best shown by FIG. 7, strip 66 is preferably captured within a pocket created by a folded edge of a panel of material forming floor 32. Rigidifying strip 66 provides each compartment 16 with a uniform straight floor or linear lower edge so as to maintain the shape of the mouth 38 of each compartment 16. In the exemplary embodiment, each strip 66 is formed from a polymeric material. Alternatively, each strip 66 may be formed from other more rigid materials such as wood, cardboard or paperboard, or metal. Although less desirable, rigidifying strip 66 may be omitted in particular applications. Alternatively, the entire floor 32 may be situated proximate to a rigidifying member or panel. Because strip 66 merely extends along a frontward most edge of mouth 38, the weight of organizer 10 is reduced.

In lieu of being captured within a cavity below floor 32, rigidifying member 66 may alternatively comprise a substantially rigid panel which is inserted into the interior of each compartment 16 so as to provide floor 32. Although adding weight to organizer 10, such a panel would provide a removable floor which could easily be replaced should the floor become soiled.

Figure 8:
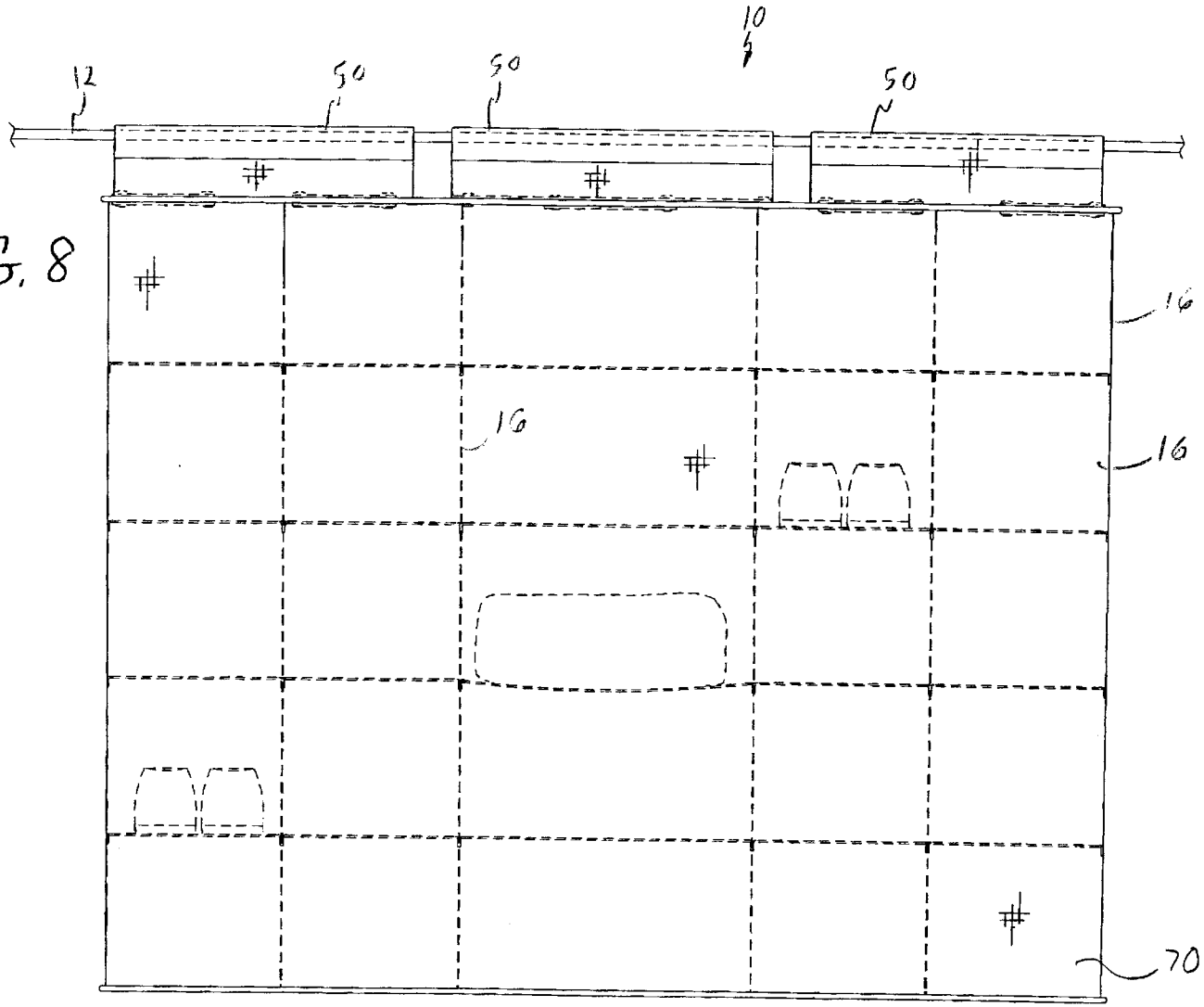
FIG. 8 is a rear elevational view of the organizer of FIG. 1.

As best shown by FIG. 8, a rear elevational view of organizer 10, each compartment 16 preferably has a back wall 70 opposite mouth 38. In the exemplary embodiment, a single continuous panel of material provides back wall 70 for each of compartment 16. The panel is preferably formed from a lightweight flexible and breathable material such as canvas. Alternatively, other flexible materials may be employed such as polymers and the like to prevent back walls 70 from accidentally being inserted too far into compartment 16 so as to fall through on the back side of organizer 10. Although less desirable, back wall 70 may be omitted in particular applications.

Figure 9:
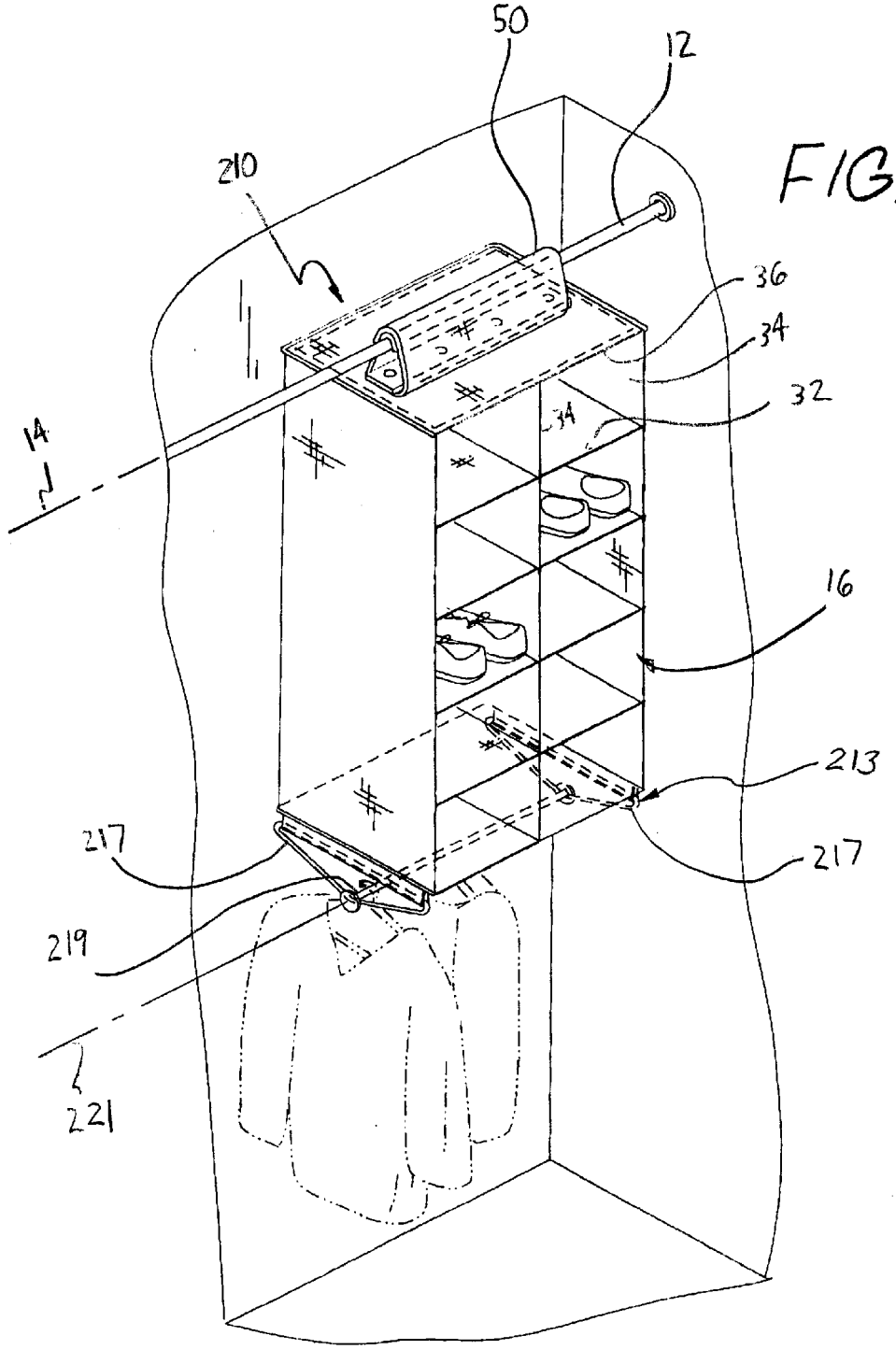
FIG. 9 is a perspective view of a first alternative embodiment of the organizer of FIG. 1 suspended from a closet rod.
Figure 10:
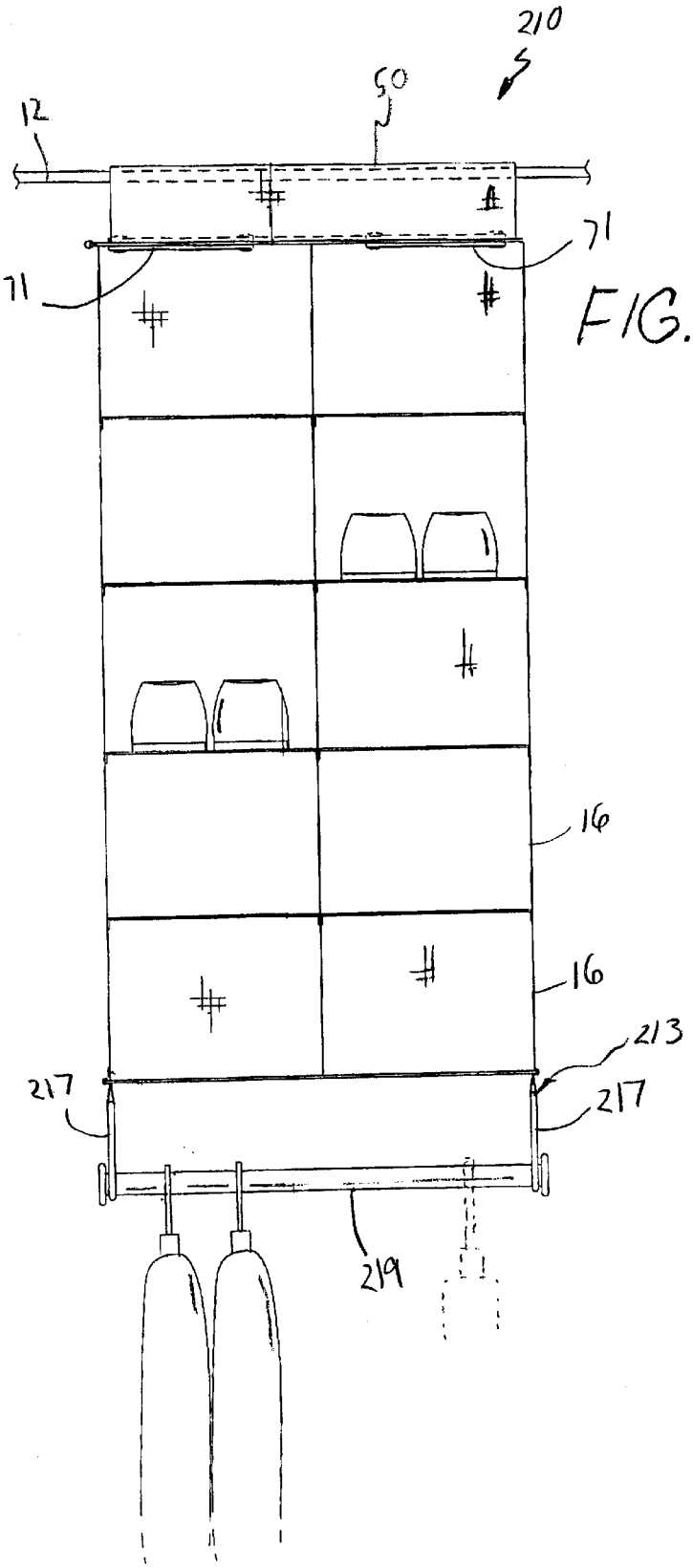
FIG. 10 is a front elevational view of the organizer of FIG. 9.
Figure 11:
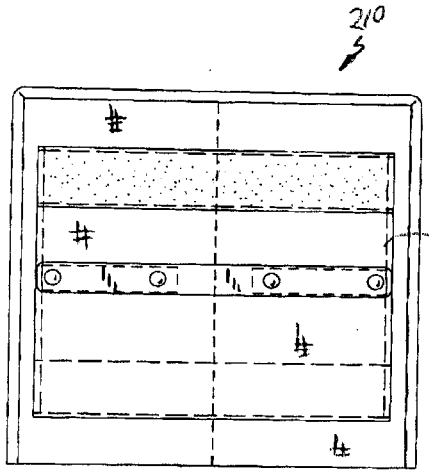
FIG. 11 is a top plan view of the organizer of FIG. 9 separated from the closet rod.

FIG. 9 illustrates organizer 210, a second alternative embodiment of organizer 10, hung from a closet rod 12 extending along axis 14. Organizer 210 is similar to organizer 110 since organizer 210 has a fewer number of compartments 16, has a single suspender 50, and additionally includes hang bar system 213. In addition, the lowermost row of compartments 16 includes a rigidifying panel 215 (shown in FIG. 13) which extends completely below each of the lowermost compartments 16 to provide a support structure 4 and hang bar system 213. In the preferred embodiments illustrated, rigidifying panel 215 is further braced by an optional rigid metallic tube affixed to an underside of member 215 and transversely extending across substantially the entire lower surface of member 215. For ease of illustration, those remaining components of organizer 210 which are substantially similar to corresponding components of organizer 10 are numbered similarly.

Hang bar system 213 is suspended below compartment 16 and generally includes supports 217 and hang bar 219. Supports 217 suspend or support hang bar 219 below compartment 16 such that hang bar 219 extends along an axis 221 substantially parallel to axis 14 and closet rod 12 which organizer 210 is hung from closet rod 12. In the preferred embodiment illustrated, supports 217 are located on the opposite transverse ends of compartments 16 so as to engage opposite ends of hang bar 219. Alternatively, a greater number of supports 217 may be utilized or a single support 217 may be utilized to support hang bar 219.

Figure 12:
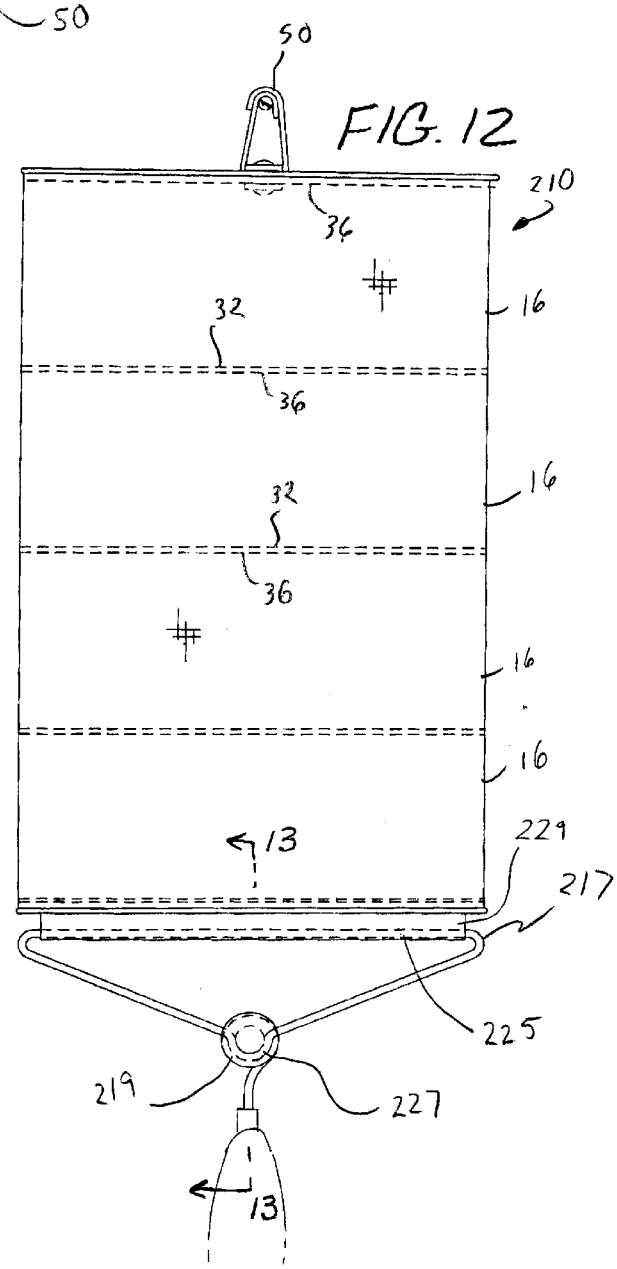
FIG. 12 is a side elevational view of the organizer of FIG. 9.
Figure 13:
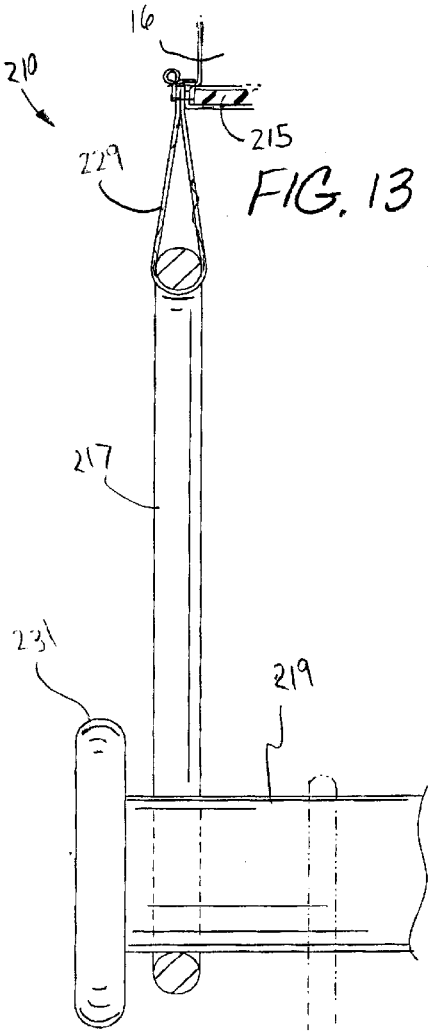
FIG. 13 is an enlarged fragmentary sectional view of the organizer of FIG. 12 taken along line 13—13.

As best shown by FIGS. 12 and 13, each support 217 preferably comprises a triangular shaped structure having a base portion 225 coupled to compartment 16 and an apex 227 configured to engage hang bar 219. In view of its triangular configuration, hang bar 219 is automatically centered by support 217 below compartments 16. In the preferred embodiment, apex portion 227 includes a detent comprised to snuggly receive hang bar 219 to more stably retain hang bar 219 in place. Support 217 is preferably formed from a rigid metal. Alternatively, support 217 may be made from a rigid plastic or other material. Moreover, although less desirable, support 217 may have other configurations so as to support hang bar 217 below compartments 16. For example, support 227 may alternatively comprise a hook, sleeve or other opening configured to receive and support hang bar 219. Although each of supports 217 is illustrated as being configured to enable hang bar 219 to be released or disconnected from supports 217 by lifting hang bar 219 to enable hang bar 219 to be easily removed, supports 217 may alternatively be permanently fixed or secured to hang bar 219 by fasteners, welding, bonding or other methods.

In the particular embodiment illustrated, support 217 is coupled to compartments 16 by means of a fabric sleeve 229 sewn or otherwise fastened to the remainder of organizer 210. Sleeve 229 is preferably formed from the same flexible material as the remainder of compartment 16. Sleeve 229 encircles hanger 217. Although sleeve 229 is illustrated as permanently encircling supports 217, sleeve 229 may alternatively be openable so as to enable supports 217 to be released from sleeve 229.

Hang bar 219 extends between supports 217 in a direction parallel to axis 14 of closet rod 12. Hang bar 219 preferably includes end caps 231 to prevent hang bar 219 from becoming dislodged from supports 217. Although hang bar 219 is illustrated as an elongate, generally cylindrical rod or tube, hang bar 219 may comprise any variety of alternative structures configured to hang or suspend apparel or other garments positioned on conventionally known hangers. In particular applications where clothes or apparel are located upon specially designed hangers or hanging mechanisms, hang bar 219 may be appropriately reconfigured to accommodate such specially designed clothes hanging mechanisms. Furthermore, in lieu of organizer 210 including a single hang bar 219, organizer 210 may be provided with a plurality of hang bars 219 suspended below compartments 16 in alignment with one another or offset from one another, either vertically or horizontally. For example, organizer 210 may be provided with a plurality of hang bars horizontally or vertically offset from one another to indicate different categories or types of apparel being hung from the respective plurality of hang bars.

Furthermore, in lieu of being specifically configured to hang apparel supported by hangers, other hanging mechanisms may be suspended below compartment 16 for hanging other items. For example, an alternative apparel storage member may be configured to additionally or alternatively suspend a plurality of neckties below compartment 16.

Figure 14:
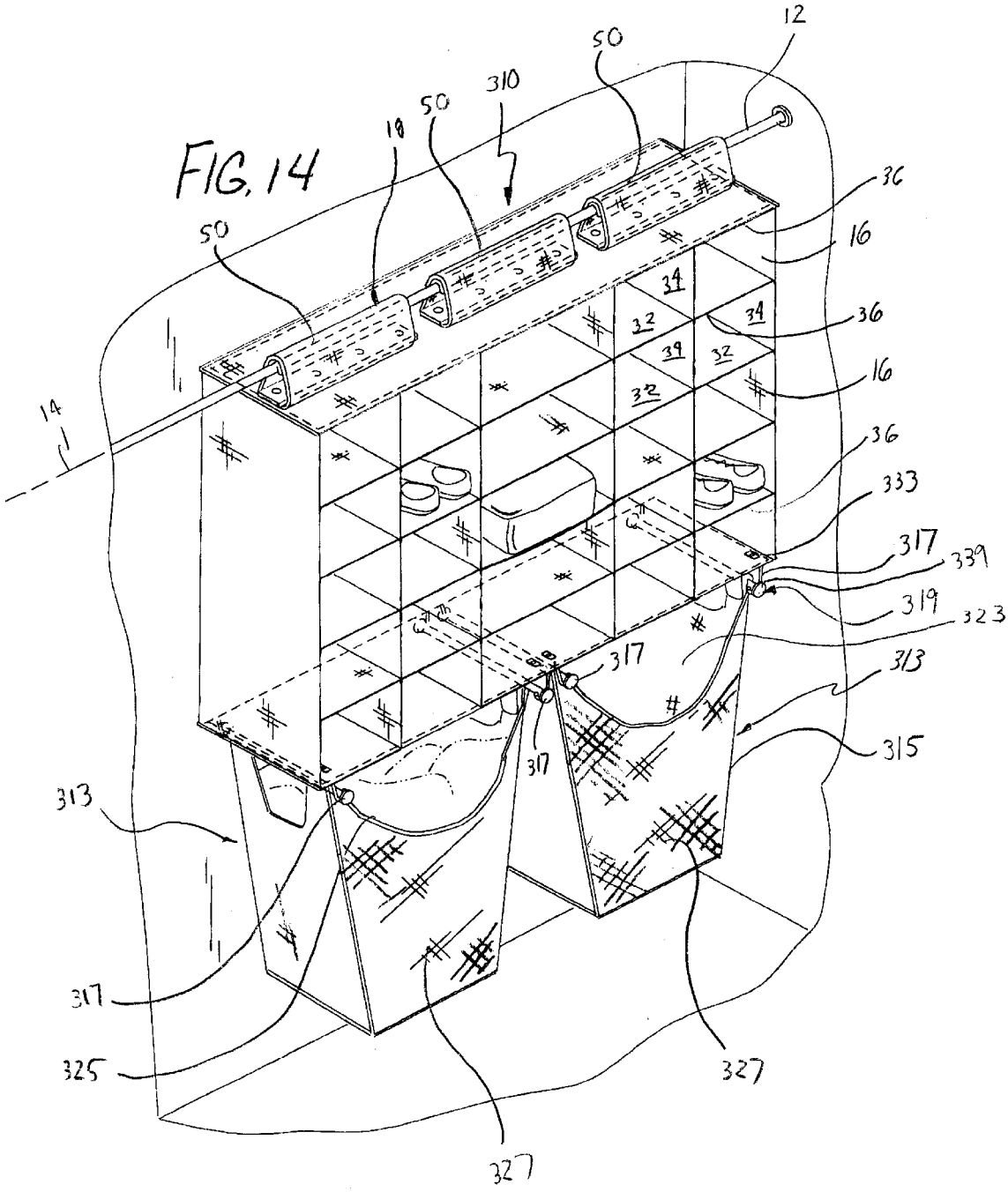
FIG. 14 is a perspective view of a second alternative embodiment of the organizer of FIG. 1.
Figure 15:
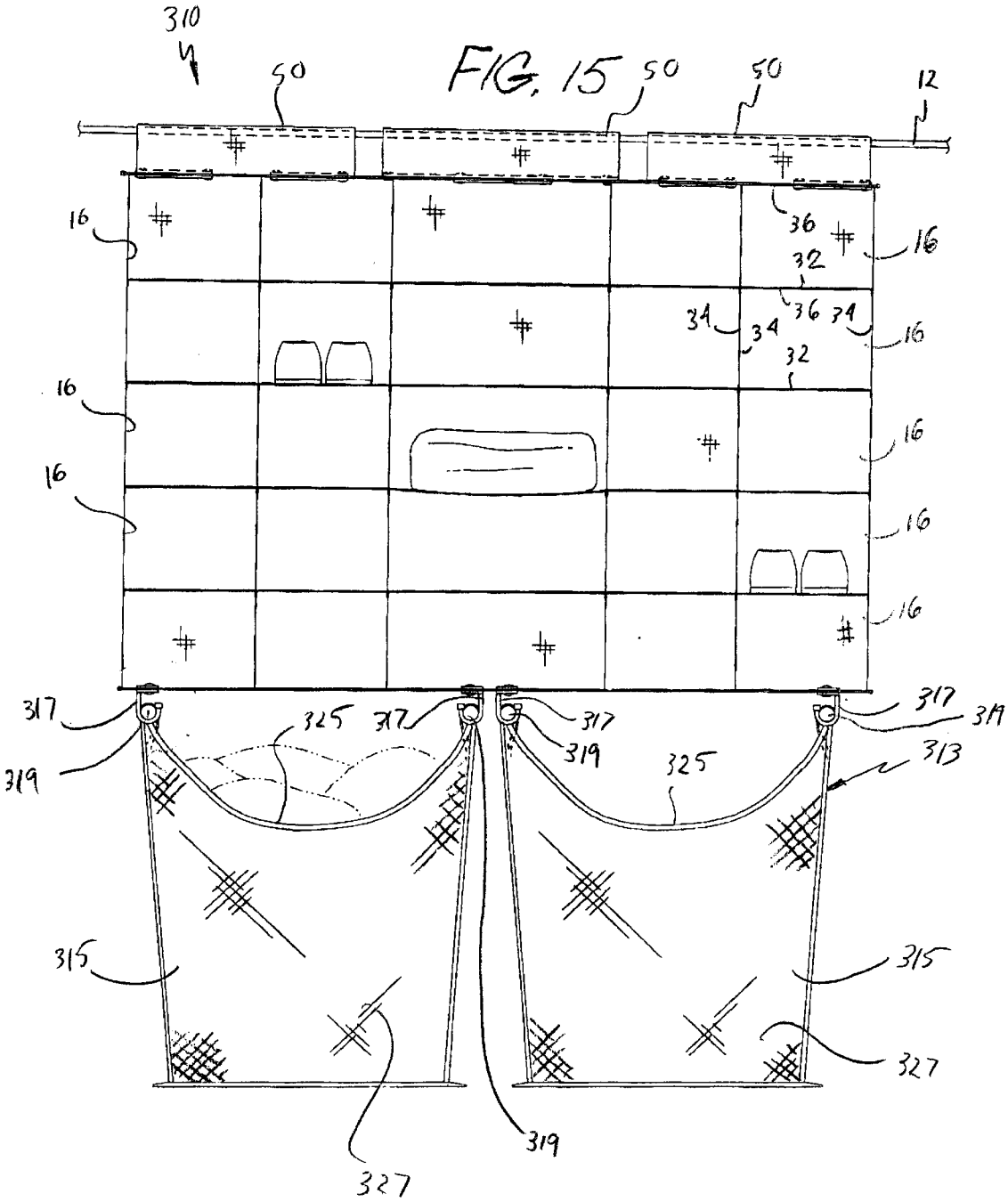
FIG. 15 is a front elevational view of the organizer of FIG. 14.
Figure 16:
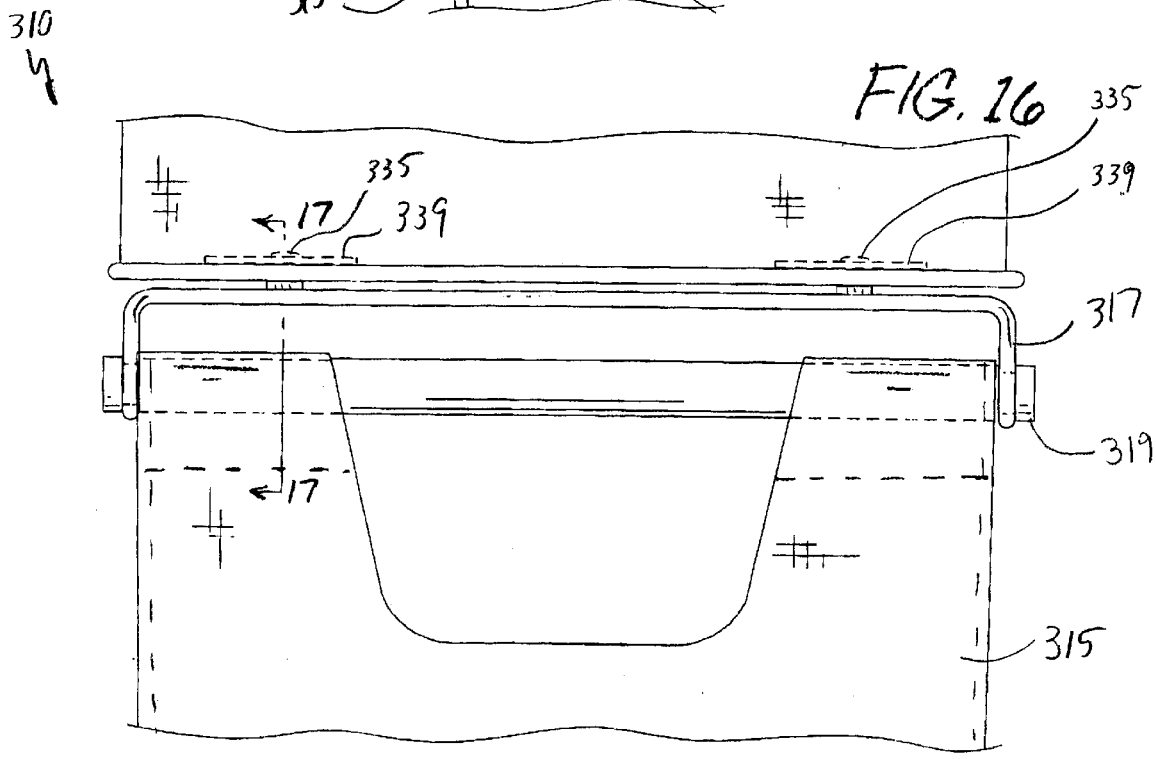
FIG. 16 is an enlarged fragmentary side elevational view of the organizer of FIG. 14.

FIGS. 14–16 illustrate organizer 310, a third alternative embodiment of organizer 10. Organizer 310 is substantially similar to organizer 10, except that organizer 310 additionally includes hamper systems 313. For ease of illustration, those remaining components of organizer 310 which are substantially similar to the corresponding components of organizer 10 are numbered similarly. Hamper systems 313 generally comprise apparel or garment storage members suspended below compartments 16. In the preferred embodiments illustrated, systems 313 each include a hamper 315 suspended below compartments 16 by supports 317 and cross poles 319. Systems 313 enable additional clothing or garments to be temporarily stored below compartments 16 to optimally utilize closet space. In the particular embodiment illustrated, systems 313 enable laundry to be temporarily stored below compartments 16.

As best shown by FIGS. 14 and 15, hampers 315 each generally comprise a container having an interior 323 sized to receive a plurality of pieces of apparel or garments. In the particular embodiment illustrated, each hamper 315 comprises an open-topped container having a mouth 325 facing upward in a direction towards compartment 16. Each hamper 313 additionally includes at least a portion that is perforate to enable contents within the hamper 313 to be easily viewed and identified and to further provide ventilation through hamper 313. In the particular embodiment illustrated, a forward most wall 327 of each of hampers 313 is perforated. In particular, front wall 327 comprises a netting or mesh material.

Although organizer 310 is illustrated as including two side-by-side hampers 313 substantially identical to one another, organizer 310 may alternatively include a single hamper 313 or greater than two hampers 313 having the same or different configurations. In addition, the configuration of hampers 313 themselves may be varied. For example, of hampers 313 having a mouth 325 facing compartment 16, hampers 313 may alternatively include a sideways directed opening or mouth. In lieu of having an entire front wall 327 which is perforated, only portions of front wall 327 may be perforated. Moreover, in lieu of perforations, front wall 327 or other portions of hamper 313 may include portions formed from transparent material so as to facilitate better viewing of the contents of hampers 313.

In the preferred embodiment, each of hampers 313 is formed from flexible, lightweight materials to reduce the load placed upon closet rod 12. The materials forming hampers 313 are preferably breathable. In embodiments where hampers 313 are removable from the remainder of organizer 310, hampers 313 are also preferably formed from machine washable materials, such that hampers 313 themselves may be separated from organizer 310 and washed with the laundry they may contain. In the exemplary embodiment, hampers 313 are entirely formed machine washable materials including canvas and fabric netting. In one embodiment, hampers 313 include bottoms which are also formed from a perforate fabric netting material.

Figure 17:
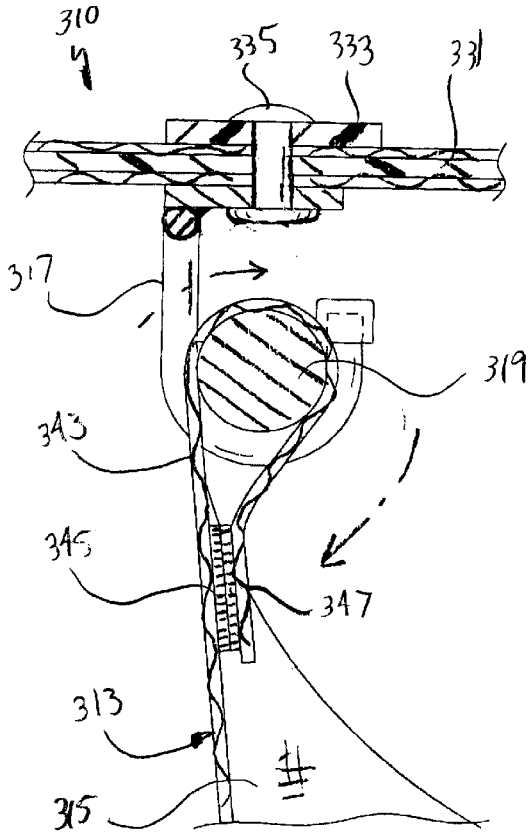
FIG. 17 is an enlarged fragmentary sectional view of the organizer of FIG. 16 taken along line 17—17.

Supports 317 and cross poles 319 cooperate to releasably suspend hampers 313 below compartments 16. As best shown by FIG. 16, supports 317 generally comprise hooks coupled to compartment 16. Supports 317 suspend cross poles 319 at spaced apart locations below compartment 16. At the same time, supports 317 enable cross poles 319 to be lifted and separated from supports 317 such that hamper 315 may also be separated from support 317 and compartments 16. As shown by FIG. 17, the floors 32 of the lowermost compartments 16 are rigidified by a rigidifying panel 331 which preferably extends across the entire bottom of compartments 316. Supports 317 are coupled to this rigid panel 331 by a fastener 335 (shown as a rivet) extending through panel 331. In the preferred embodiment, the fastener comprises a rigid brace 333 formed from a material such as plastic through which a fastener 335 extends. Alternatively, support 317 may be coupled to a lowermost portion of compartments 16 by other conventionally known or future developed fastening methods.

Cross poles 319 comprise elongate bars or rods configured to be releasably received within the hooks provided by supports 317. Cross poles 319 each preferably include an end cap 339 to retain cross poles 319 upon supports 317. Alternatively, other retention mechanisms may be employed. For example, cross poles 339 may be provided with circumferential grooves (such as depicted in FIG. 16) adapted to receive a hook portion of supports 317 or supports 317 may themselves be configured to releasably engage cross poles 319 to prevent their inadvertent dislodgment.

Cross poles 339 are coupled to spaced portions of hampers 313. In the exemplary embodiment, cross poles 319 are coupled to each of the opposing corners of hampers 313. As a result, cross poles 319 assist in maintaining hamper 313 in a fully stretched or extended condition when suspended below compartment 16.

As best shown by FIG. 17, hampers 313 are releasably coupled to cross poles 319. In particular, each hamper 313 includes an upper flap 343 having a first portion provided with a first component 345 of a hook and loop fastener system and a second portion provided with a second component 347 of a hook and loop fastener. Flap 343 encircles cross pole 319 and is secured to itself by the hook and loop fastener system. As a result, hamper 313 may be released and separated from cross poles 319 while cross poles 319 remain suspended by supports 317. Thus, hampers 313 may be quickly and easily dislodged for transportation to a laundry facility or a laundry room. As discussed above, hampers 313 may alternatively be left secured to cross poles 319, whereas cross poles 319 may be separated from supports 317 and utilized as handles for carrying hampers 313.

In lieu of being releasably coupled to cross poles 319 by a hook and loop fastener mechanism, hampers 313 may alternatively be releasably coupled to cross poles 319 by various other releasable fastening methods or mechanisms such as buttons, buckles and the like. Although less desirable, the upper portions of hampers 313 may alternatively simply comprise a permanent sleeve or loop which receives cross poles 319, wherein hampers 313 may be separated from cross poles 319 by axially withdrawing cross poles 319 from the sleeves. In yet alternative embodiments, hampers 313 may be permanently affixed to cross poles 319. In yet additional embodiments, cross poles 319 may have alternative configurations such as bars or other elongate members. Furthermore, cross poles 319 may be omitted, wherein spaced portions of hampers 313 are directly suspended from supports 317 or other support structures coupled to compartments 16. Although less desirable, hampers 313 may alternatively be suspended below compartments 316 at a single point such as a single hook. Such an alternative embodiment is viewed as less desirable since tension upon the hamper may cause the opening of the hamper to constrict.

Overall, organizers 10, 110, 210 and 310 provide lightweight, user-friendly organization systems that compartmentalize stored items, that facilitate viewing of the stored items, that are relatively stable, and that efficiently use available storage space. Organizers 210 and 310 additionally enable the storage of garments or other components below horizontal compartments. In the case of organizer 210, hang bar system 213 enables garments positioned upon hangers to be easily hung below compartments 16. In the case of organizer 310, system 313 enables loose garments or clothing, such as laundry, to be easily stored below compartments 16.

Although the present invention has been described with reference to preferred embodiments, workers skilled in the art will recognize that changes may be made in form and detail without departing from the spirit and scope of the invention. For example, although different preferred embodiments may have been described as including one or more features providing one or more benefits, it is contemplated that the described features may be interchanged with one another or alternatively be combined with one another in the described preferred embodiments or in other alternative embodiments. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. An organizer for use with a closet rod extending along an axis, the organizer comprising:

a plurality of compartments at least partially formed from a flexible material;

a first suspender coupled to the plurality of compartments, wherein the first suspender is configured and adapted to hang the plurality of compartments from the closet rod; and at least one apparel storage member hung below the plurality of compartments.

2. The organizer of claim 1, wherein the at least one apparel storage member is selected from the group consisting of a hamper, a hang bar, and a necktie suspension member.

3. The organizer of claim 2, wherein the at least one apparel storage member is releasably hung below the plurality of compartments.

4. The organizer of claim 1, wherein the at least one apparel storage member includes a pair of side-by-side hampers hung below the plurality of compartments.

5. The organizer of claim 4 wherein the pair of side-by-side hampers are releasably hung from the plurality of compartments.

6. The organizer of claim 1, wherein the at least one apparel storage member includes at least one hamper suspended from a plurality of spaced locations.

7. The organizer of claim 6, wherein the at least one hamper is releasably coupled to the plurality of compartments at the plurality of spaced locations.

8. The organizer of claim 1, wherein the at least one apparel storage member includes at least one hamper having a plurality of corners and wherein each corner is coupled to the plurality of compartments.

9. The organizer of claim 8, wherein the at least one hamper has a rectangular cross section having four corners and wherein each corner is coupled to the of compartments.

10. The organizer of claim 1, wherein the at least one apparel storage member includes at least one hamper having a hamper mouth facing the plurality of compartments.

11. The organizer of claim 10, wherein the at least one hamper has a perforate portion configured to facilitate viewing of laundry within the at least one hamper.

12. The organizer of claim 1, wherein the at least one apparel storage member includes at least one hamper having a perforate portion configured to facilitate viewing of laundry within the at least one hamper.

13. The organizer of claim 1, wherein the at least one apparel storage member includes at least one hang bar extending along a hang bar axis parallel axis of the closet rod.

14. The organizer of claim 1, wherein the flexible material comprises a fabric.

15. The organizer of claim 14, wherein the fabric comprises a canvas material.

16. The organizer of claim 1, wherein the plurality of compartments includes at least one compartment having a generally rectangular cross section.

17. The organizer of claim 1, wherein each compartment of the plurality of compartments has a floor, a pair of sidewalls extending from the floor, and a mouth between the sidewalls, and wherein the first suspender is configured and adapted to hang the plurality of compartments from the closet rod such that each mouth faces in a forward horizontal direction perpendicular to the axis of the closet rod when the organizer is hung from the rod.

18. The organizer of claim 17, wherein the pair of sidewalls extend parallel to each other.

19. The organizer of claim 1, wherein the plurality of compartments includes a first compartment dimensioned so as to be adapted to receive a pair of shoes.

20. The organizer of claim 1, wherein the plurality of compartments includes a compartment dimensioned so as to be adapted to receive a folded a large adult male sweater.

21. The organizer of claim 1, wherein the plurality of compartments includes a compartment having a width of at least about 4.5 inches.

22. The organizer of claim 21, wherein the compartment has a height of at least about 5.0 inches.

23. The organizer of claim 1, wherein the at least one apparel storage member includes at least one hamper, the at least one hamper being substantially formed from a machine washable, flexible material, and wherein the organizer further includes cross poles releasably coupled to the at least one hamper on opposite sides of the at least one hamper, wherein the cross poles are plurality of compartments.

24. The organizer of claim 23, wherein the cross poles are releasably coupled to the plurality of compartments.

25. A hamper system comprising:

an organizer having a plurality of compartments formed from a flexible material;

a container having an interior sized to receive a plurality of pieces of apparel or garment; and a suspension support coupled to the container and configured to releasably couple the container to the plurality of compartments below the plurality of compartments.

26. The hamper system of claim 25, wherein the container is releasably coupled to the suspension support.

27. The hamper system of claim 26, wherein the container is releasably coupled to the suspension support by a hook and loop fastener.

28. The hamper system of claim 25, wherein the container is substantially formed from a flexible material.

29. The hamper system of claim 28, wherein the container is substantially formed from a fabric.

30. The hamper system of claim 28, wherein the container has a mouth configured to face the plurality of compartments when the hamper is hung below the plurality of compartments.

31. The hamper system of claim 28, wherein the container includes at least one partially translucent portion configured to permit the contents of the container to be viewed.

32. The hamper system of claim 31, wherein the container includes at least one perforated portion.

33. The hamper system of claim 25 wherein the suspension support includes opposing cross poles coupled to the container on opposite sides of the container.

34. An organizer for use with a closet rod extending along an axis, the organizer comprising:

a plurality of compartments formed from a fabric material;

means for suspending the plurality of compartments from the closet rod; and a container releasably hung from the plurality of compartments.

* * * * *